US008115369B2

(12) United States Patent
Kang et al.

(10) Patent No.: US 8,115,369 B2
(45) Date of Patent: Feb. 14, 2012

(54) LIGHTING DEVICE

(75) Inventors: Seok Jin Kang, Seoul (KR); Tae Young Choi, Seoul (KR); Sungho Hong, Seoul (KR); Dong Soo Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 12/941,523

(22) Filed: Nov. 8, 2010

(65) Prior Publication Data

US 2011/0109216 A1 May 12, 2011

(30) Foreign Application Priority Data

Nov. 9, 2009 (KR) ..... 10-2009-0107498
Apr. 7, 2010 (KR) ..... 10-2010-0032063

(51) Int. Cl.
*H05B 33/02* (2006.01)

(52) U.S. Cl. ..... 313/45; 257/717; 257/706; 362/294

(58) Field of Classification Search ..... 257/40, 257/72, 98–100, 642–643, 759; 313/498–512; 315/169.1, 169.3; 427/58, 64, 66, 532–535, 427/539; 428/690–691, 917; 438/26–29, 438/34, 82, 455; 445/24–25
See application file for complete search history.

(56) References Cited

U.S. PATENT DOCUMENTS

| | | | | |
|---|---|---|---|---|
| 5,785,418 | A * | 7/1998 | Hochstein | 362/373 |
| 2009/0167134 | A1 * | 7/2009 | Tsao et al. | 313/46 |
| 2010/0001294 | A1 * | 1/2010 | Faller et al. | 257/79 |

FOREIGN PATENT DOCUMENTS

| | | |
|---|---|---|
| JP | 2008-204671 | 9/2008 |
| KR | 10-2008-0088890 | 10/2008 |
| KR | 10-2009-0046120 | 5/2009 |
| KR | 10-2009-0066262 | 6/2009 |
| KR | 10-2009-0072768 | 7/2009 |
| KR | 10-2009-0095903 | 9/2009 |
| KR | 20-2009-0009585 | 9/2009 |
| KR | 10-2009-0119287 | 11/2009 |

* cited by examiner

*Primary Examiner* — Nimeshkumar Patel
*Assistant Examiner* — Donald Raleigh
(74) *Attorney, Agent, or Firm* — Ked & Associates LLP

(57) ABSTRACT

Disclosed is a lighting device. The lighting device includes:
a substrate;
a light emitting device disposed on the substrate;
a heat radiating body radiating heat from the light emitting device; and
a pad being interposed between the substrate and the heat radiating body and transferring heat generated from the light emitting device to the heat radiating body and comprising silicon of 10 to 30 wt %, a filler of 70 to 90 wt %, glass fiber of 2 to 7 wt % in terms of weight percent (wt %).

20 Claims, 11 Drawing Sheets

(a)

(b)

LIGHTING DEVICE

The present application claims priority under 35 U.S.C. §119(e) of Korean Patent Applications Nos. 10-2009-0107498 filed on Nov. 9, 2009 and 10-2010-0032063 filed on Apr. 7, 2010, which is hereby incorporated by reference in its entirety.

BACKGROUND

1. Field

This embodiment relates to a lighting device.

2. Description of the Related Art

A light emitting diode (LED) is a semiconductor element for converting electric energy into light. The LED has advantages of low power consumption, a semi-permanent span of life, a rapid response speed, safety and an environment-friendliness. Therefore, many researches are devoted to substitution of the existing light sources with the LED. The LED is now being increasingly used as a light source for lighting devices, for example, various lamps used interiorly and exteriorly, a liquid crystal display device, an electric sign and a street lamp and the like.

SUMMARY

One embodiment is a lighting device. The lighting device includes:

a substrate;

a light emitting device disposed on the substrate;

a heat radiating body radiating heat from the light emitting device; and a pad being interposed between the substrate and the heat radiating body and transferring heat generated from the light emitting device to the heat radiating body and comprising silicon of 10 to 30 wt %, a filler of 70 to 90 wt %, glass fiber of 2 to 7 wt % in terms of weight percent (wt %).

Another embodiment is a lighting device. The lighting device includes:

a substrate;

a light emitting device disposed on the substrate;

a heat radiating body radiating heat from the light emitting device; and a pad being interposed between the substrate and the heat radiating body and comprising a plurality of layers.

Further another embodiment is a lighting device. The lighting device includes:

a light emitting module substrate including a plurality of light emitting devices;

a pad being disposed on one side of the light emitting module substrate and including a plurality of layers;

a heat radiating body including a receiving groove for receiving the pad and the light emitting module substrate so that one side of the heat radiating body contacts with the pad and the light emitting module substrate;

an outer case being spaced apart at a predetermined interval from the outer surface of the heat radiating body and surrounding the heat radiating body.

DETAILED DESCRIPTION OF THE EMBODIMENTS

Hereinafter, an embodiment will be described in detail with reference to the accompanying drawings.

It will be understood that when an element is referred to as being 'on' or "under" another element, it can be directly on/under the element, and one or more intervening elements may also be present.

Figure 1:
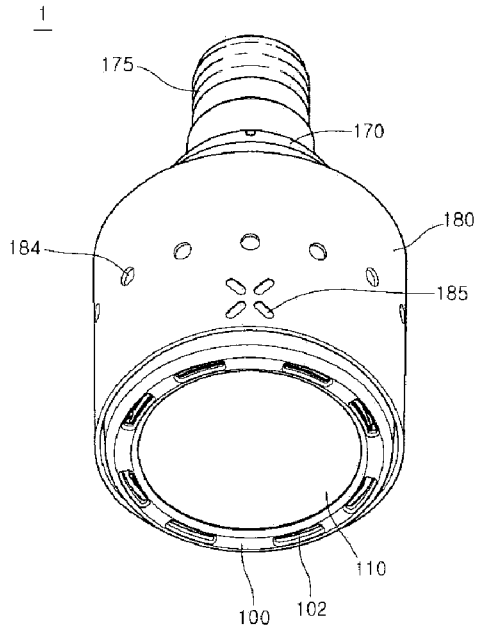
FIG. 1 is a bottom perspective view of a lighting device according to an embodiment of the present invention.
Figure 2:
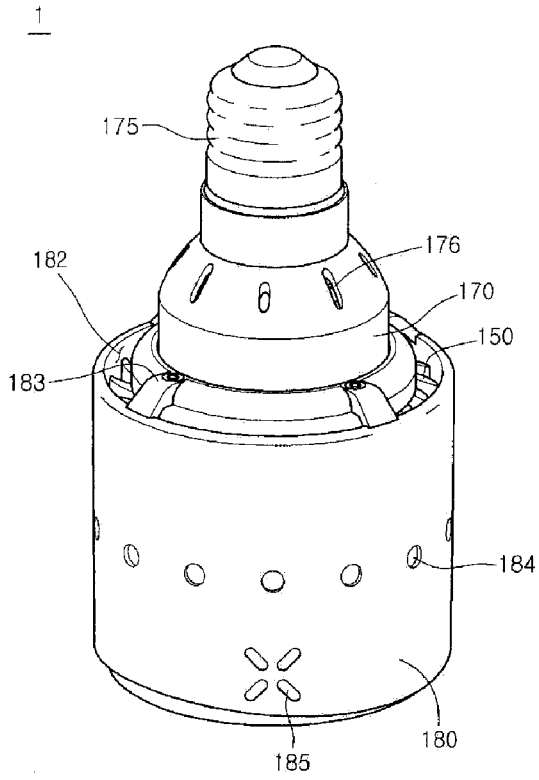
FIG. 2 is a top perspective view of the lighting device of FIG. 1.
Figure 3:
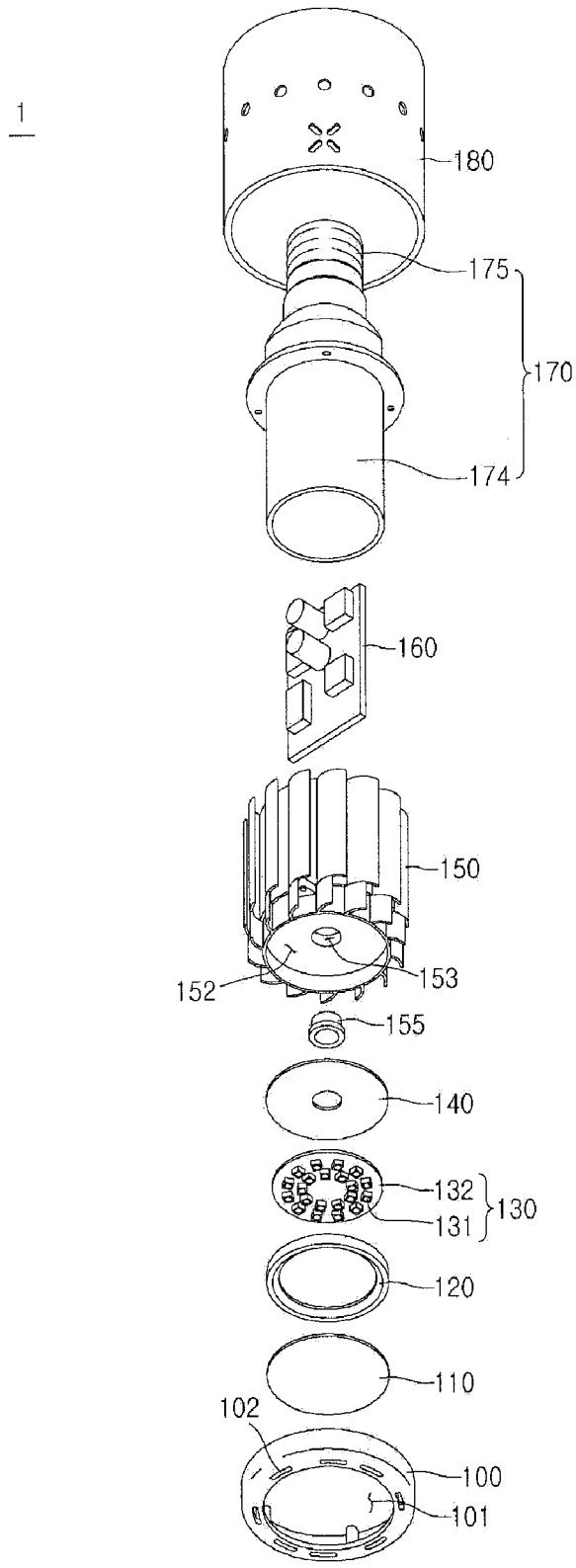
FIG. 3 is an exploded perspective view of the lighting device of FIG. 1.
Figure 4:
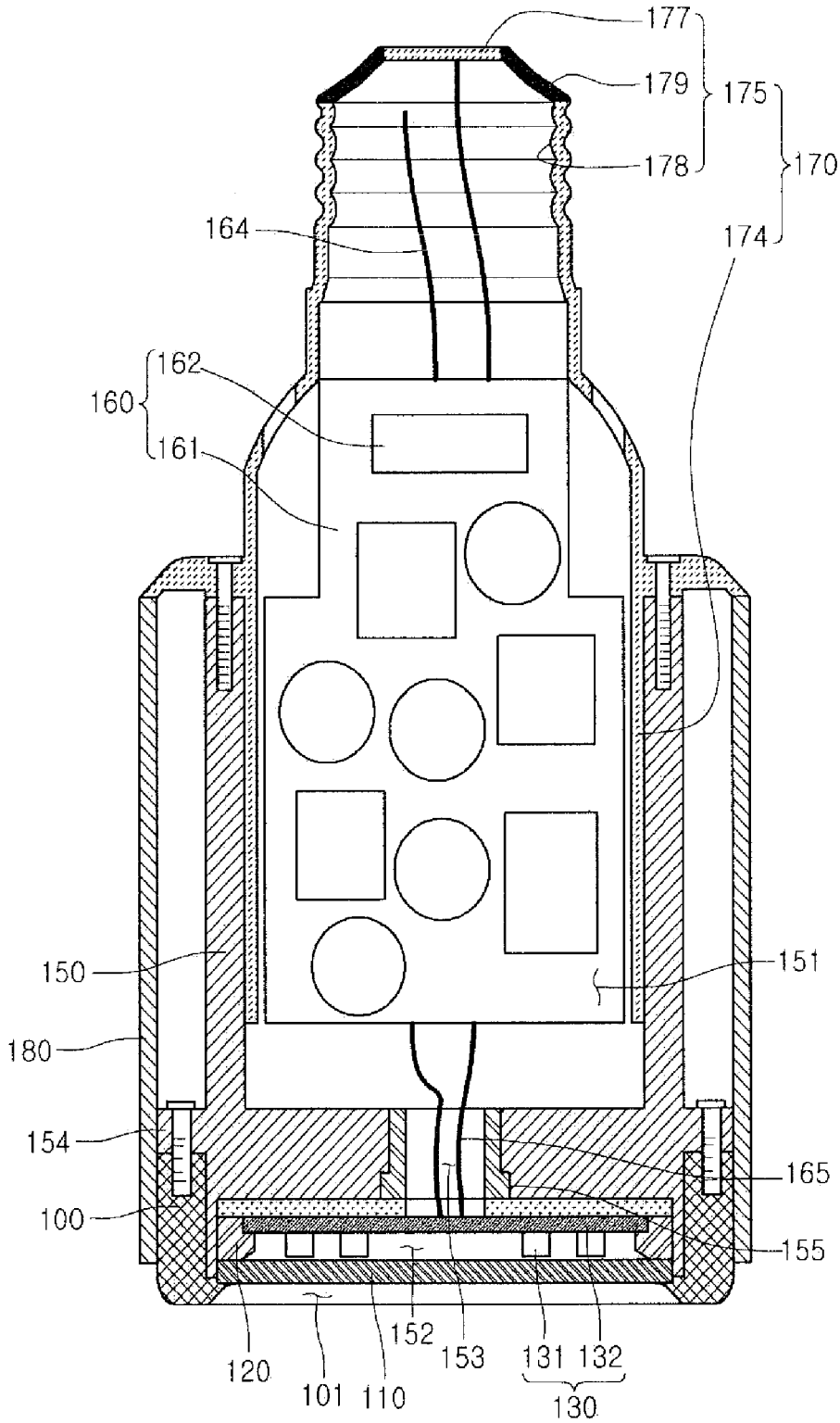
FIG. 4 is a cross sectional view of the lighting device of FIG. 1.

FIG. 1 is a bottom perspective view of a lighting device 1 according to an embodiment of the present invention. FIG. 2 is a top perspective view of the lighting device 1. FIG. 3 is an exploded perspective view of the lighting device 1. FIG. 4 is a cross sectional view of the lighting device 1.

Referring to FIGS. 1 to 4, the lighting device 1 includes an inner case 170 of which the upper part includes a connection terminal 175 and of which the lower part includes an insertion unit 174, a heat radiating body 150 including a first receiving groove 151 into which the insertion unit 174 of the inner case 170 is inserted, a light emitting module substrate 130 emitting light onto a bottom surface of the heat radiating body 150 and including one or a plurality of light emitting devices 131, a guide member 100 being coupled to the circumference of the lower part of the heat radiating body 150 and strongly fixing the light emitting module substrate 130 to the heat radiating body 150, and an outer case 180 outside the heat radiating body 150.

The heat radiating body 150 includes receiving grooves 151 and 152 on both sides thereof and receives the light emitting module substrate 130 and a driving unit 160. The heat radiating body 150 functions to radiate heat generated from the light emitting module substrate 130 or/and the driving unit 160.

Specifically, as shown in FIGS. 3 and 4, the first receiving groove 151 in which the driving unit 160 is disposed is formed on a top surface of the heat radiating body 150. A second receiving groove 152 in which the light emitting module substrate 130 is disposed is formed on the bottom surface of the heat radiating body 150.

An outer surface of the heat radiating body 150 has a prominence and depression structure. The prominence and depression structure causes the surface area of the heat radiating body 150 to be increased, improving heat radiation efficiency. The heat radiating body 150 is made of a metallic material or a resin material which has excellent heat radiation efficiency. However, there is no limit to the material of the heat radiating body 150. For example, the material of the heat radiating body 150 may include at least one of Al, Ni, Cu, Ag, Sn and Mg.

The light emitting module substrate 130 is disposed in the second receiving groove 152 formed on the bottom surface of the heat radiating body 150. The light emitting module substrate 130 includes a substrate 132 and either one or a plurality of the light emitting devices 131 disposed on the substrate 132. A plurality of the light emitting devices may be disposed in a radial shape based on a central axis of the substrate 132.

The one or each of the plurality of the light emitting devices 131 includes at least one light emitting diode (hereinafter, referred to as LED). The LEDs include red, green, blue and white LEDs, each of which emits red, green, blue and white lights respectively. The number and kind of the LED are not limited to this.

The light emitting module substrate 130 is electrically connected to the driving unit 160 by a wiring, etc., via a through-hole 153 passing through a basal surface of the heat radiating body 150. Therefore, the light emitting module substrate 130 can be driven by receiving electric power.

Here, a second protection ring 155 is formed in the through-hole 153, second protection ring 155 second protection ring 155. Therefore, it is possible to prevent moisture and impurities from penetrating between the light emitting module substrate 130 and the heat radiating body 150, to improve a withstand voltage characteristic of the lighting device, and to prevent an electrical short-circuit, EMI, EMS and so on caused by contact of the wiring with heat radiating body 150 second protection ring 155

A thermal pad 140 is attached to a bottom surface of the light emitting module substrate 130. The thermal pad 140 is attached to the second receiving groove 152. Otherwise, the light emitting module substrate 130 and the thermal pad 140 may be also integrally formed. The thermal pad 140 allows heat generated from the light emitting module substrate 130 to be more effectively transferred to the heat radiating body 150.

The light emitting module substrate 130 is securely fixed to the second receiving groove 152 by the guide member 100. The guide member 100 includes an opening 101 for exposing the one or a plurality of the light emitting devices 131 mounted on the light emitting module substrate 130. The guide member 100 can fix the light emitting module substrate 130 by pressing an outer circumferential surface of the light emitting module substrate 130 to the second receiving groove 152 of the heat radiating body 150.

The guide member 100 also includes an air flow structure for allowing air to flow between the heat radiating body 150 and the outer case 180 and maximizes heat radiation efficiency of the lighting device 1. The air flow structure may correspond to, for example, a plurality of first heat radiating holes 102 formed between an inner surface and an outer surface of the guide member 100, or a prominence and depression structure formed on the inner surface of the guide member 100. The air flow structure will be described later in detail.

At least one of a lens 110 and a first protection ring 120 may be included between the guide member 100 and the light emitting module substrate 130.

The lens 110 includes various shapes like a convex lens, a concave lens, a parabola-shaped lens and a fresnel lens, etc., so that the distribution of light emitted from the light emitting module substrate 130 can be controlled as desired. The lens 110 includes a fluorescent material and is used to change the wavelength of light. The lens 110 is used without being limited to this.

The first protection ring 120 not only prevents moisture and impurities from penetrating between the guide member 100 and the light emitting module substrate 130 but also leaves a space between an outer surface of the light emitting module substrate 130 and an inner surface of the heat radiating body 150, so that the light emitting module substrate 130 is prevented from contacting directly with the heat radiating body 150. As a result, it is possible to improve a withstand voltage characteristic of the lighting device 1 and to prevent EMI, EMS and the like of the lighting device 1.

As shown in FIGS. 3 and 4, the inner case 170 includes the insertion unit 174 and the connection terminal 175. The insertion unit 174 is formed in the lower part of the inner case 170 and is inserted into the first receiving groove 151 of the heat radiating body 150. The connection terminal 175 is formed in the upper part of the inner case 170 and is electrically connected to an external power supply.

A side wall of the insertion unit 174 is disposed between the driving unit 160 and the heat radiating body 150, and prevents an electrical short-circuit between them. Accordingly, it is possible to improve a withstand voltage characteristic of the lighting device 1 and to prevent EMI, EMS and the like of the lighting device 1.

The connection terminal 175 is inserted into an external power supply having a socket shape so that electric power can be supplied to the lighting device 1. However, the shape of the connection terminal 175 can be variously changed according to the design of the lighting device 1 without being limited to this.

The driving unit 160 is disposed in the first receiving groove 151 of the heat radiating body 150. The driving unit 160 includes a converter converting an alternating current supplied from an external power supply into a direct current, a driving chip controlling to drive the light emitting module substrate 130, an electrostatic discharge (ESD) protective device protecting the light emitting module substrate 130. The driving unit 160 is not limited to include other components.

The outer case 180 is coupled to the inner case 170, receives the heat radiating body 150, the light emitting module substrate 130 and the driving unit 160, and forms an external appearance of the lighting device 1.

While the outer case 180 has a circular section, the outer case 180 can be designed to have a polygon section or elliptical section and so on. There is no limit to the cross section shape of the outer case 180.

Since the heat radiating body 150 is not exposed by the outer case 180, it is possible to prevent a burn accident and an electric shock and to make it easier to handle the lighting device 1.

Hereinafter, the following detailed description will be focused on each component of the lighting device 1 according to the embodiment.

Heat Radiating Body 150

Figure 5:
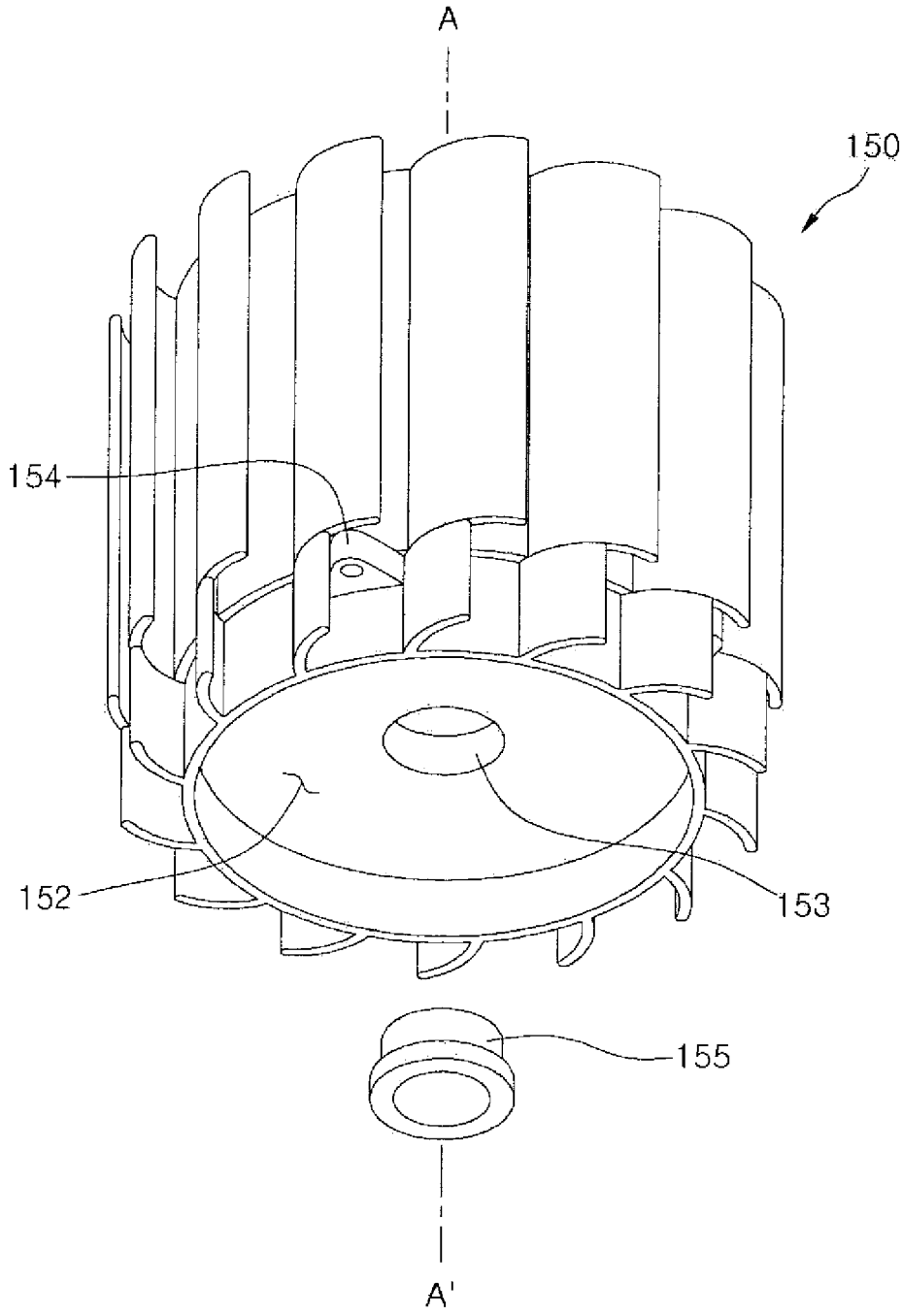
FIG. 5 is a perspective view of a heat radiating body of the lighting device of FIG. 1.
Figure 6:
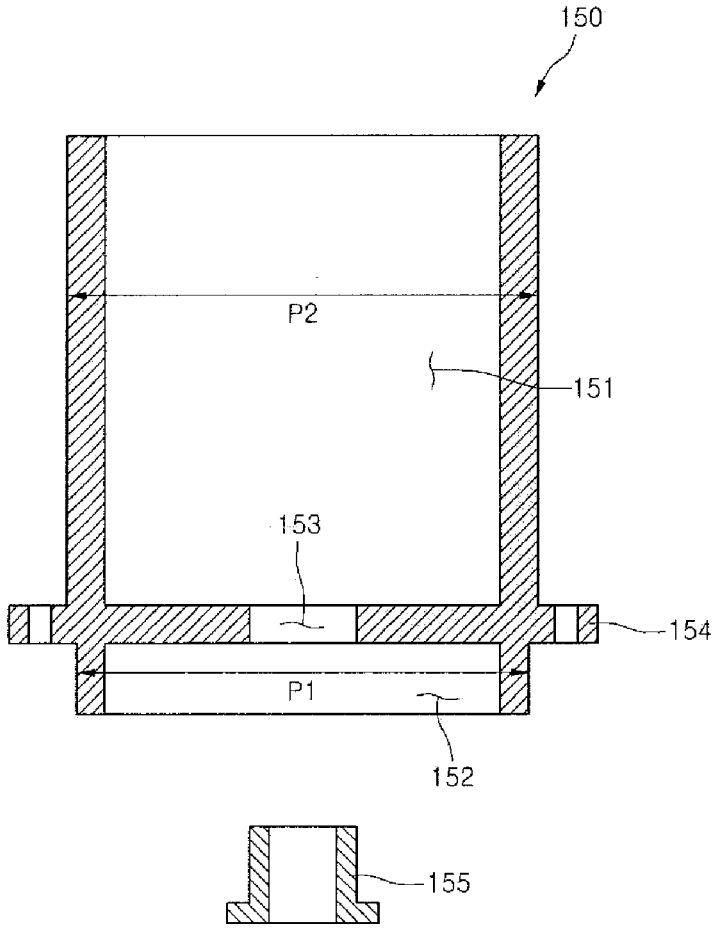
FIG. 6 is a cross sectional view taken along a line A-A' of FIG. 5.

FIG. 5 is a perspective view of the heat radiating body 150. FIG. 6 is a cross sectional view taken along a line A-A' of FIG. 5.

Referring to FIGS. 4 to 6, the first receiving groove 151 in which the driving unit 160 is disposed is formed on a first side of the heat radiating body 150. The second receiving groove 152 in which the light emitting module substrate 130 is disposed is formed on a second side opposite to the first side. Widths and depths of the first and the second receiving grooves 151 and 152 are changeable depending on the widths and thicknesses of the driving unit 160 and light emitting module substrate 130.

The heat radiating body 150 is made of a metallic material or a resin material which has excellent heat radiation efficiency. However, there is no limit to the material of the heat radiating body 150. For example, For example, the material of the heat radiating body 150 may include at least one of Al, Ni, Cu, Ag, Sn and Mg.

The outer surface of the heat radiating body 150 has a prominence and depression structure. The prominence and depression structure causes the surface area of the heat radiating body 150 to be increased, improving heat radiation efficiency. As shown, the prominence and depression structure may include a wave-shaped prominence curved in one direction. However, there is no limit to the shape of the prominence and depression.

The through-hole 153 is formed on the basal surface of the heat radiating body 150. The light emitting module substrate 130 and the driving unit 160 are electrically connected to each other by a wiring.

Here, the second protection ring 155 is coupled to the through-hole 153 so that it is possible to prevent moisture and impurities from penetrating through the through-hole 153 and to prevent an electrical short-circuit, etc., caused by contact of the wiring with heat radiating body 150. The second protection ring 155 is formed of a rubber material, a silicon material or other electrical insulating material.

A first fastening member 154 is formed on a side of the lower part of the heat radiating body 150 in order to strongly couple the guide member 100 to the heat radiating body 150. The first fastening member 154 includes a hole into which a screw is inserted. The screw can strongly couple the guide member 100 to the heat radiating body 150.

In addition, so as to easily couple the guide member 100, a first width P1 of the lower part of the heat radiating body 150 to which the guide member 100 is coupled is less than a second width P2 of another part of the heat radiating body 150. However, there is no limit to the widths of the heat radiating body 150.

Light Emitting Module Substrate 130, Thermal Pad 140 and First Protection Ring 120

Figure 7:
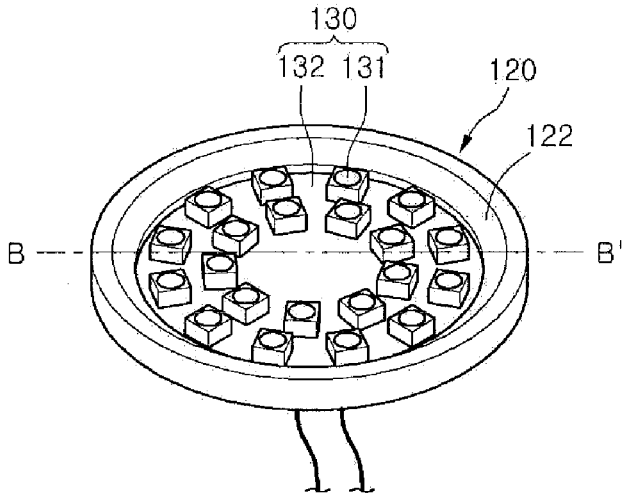
FIG. 7 is a perspective view showing coupling of a light emitting module substrate and a first protection ring of the lighting device of FIG. 1.
Figure 8:
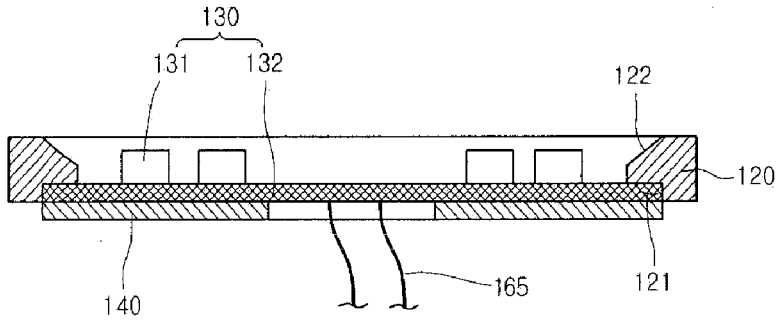
FIG. 8 is a cross sectional view taken along a line B-B' of FIG. 7.

FIG. 7 is a perspective view showing coupling of the light emitting module substrate 130 and the first protection ring 120. FIG. 8 is a cross sectional view taken along a line B-B' of FIG. 7.

Referring to FIGS. 3, 7 and 8, the light emitting module substrate 130 is disposed in the second receiving groove 152. The first protection ring 120 is coupled to the circumference of the light emitting module substrate 130.

The light emitting module substrate 130 includes the substrate 132 and one or a plurality of the plurality of the light emitting devices 131 mounted on the substrate 132.

The substrate 132 is made by printing a circuit pattern on an insulator. For example, a common printed circuit board (PCB), a metal core PCB, a flexible PCB and a ceramic PCB and the like can be used as the substrate 132.

The substrate 132 is made of a material capable of efficiently reflecting light. White and silver colors, etc., capable of efficiently reflecting light is formed on the surface of the substrate 132.

The one or a plurality of the light emitting devices 131 are mounted on the substrate 132. Each of a plurality of the light emitting devices 131 includes at least one light emitting diode (LED). The LEDs include various colors such as red, green, blue and white, each of which emits red, green, blue and white lights respectively. The number and kind of the LED are not limited to this.

Meanwhile, there is no limit in disposing one or more light emitting devices 131. However, in the embodiment, while the wiring is formed under the light emitting module substrate 130, the light emitting device is not necessarily mounted on an area of the light emitting module substrate 130, which corresponds to an area in which the wiring has been formed. For example, as shown, when the wiring is formed in the middle area of the light emitting module substrate 130, the light emitting device is not necessarily mounted on the middle area. In this case, the thermal pad may be disposed on the light emitting module substrate in correspondence with an area in which the light emitting device is disposed. Preferably, a central part of the thermal pad may be open.

The thermal pad 140 is attached to the lower surface of the light emitting module substrate 130. The thermal pad 140 is made of a material having a high thermal conductivity such as a thermal conduction silicon pad or a thermal conduction tape and the like. The thermal pad 140 can effectively transfer heat generated by the light emitting module substrate 130 to the heat radiating body 150. Here, in order to increase heat radiating effect, an area of the thermal pad is required to be at least larger than that of the light emitting module substrate.

Such a thermal pad 140 includes silicon, a filler and glass fiber. More preferably, it is desired that the thermal pad 140 is formed by adding a catalyst to the said three materials.

More specifically, in terms of weight percent (wt %), the thermal pad 140 is required to include silicon of 10 to 30 wt %, a filler of 70 to 90 wt %, glass fiber of 2 to 7 wt % and a catalyst of 0.3 to 1.5 wt %.

The silicon contributes to insulation and viscosity of the thermal pad 140. If the weight percent of the silicon is less than 10 wt %, the insulation and viscosity of the thermal pad 140 is reduced. If the weight percent of the silicon is greater than 30 wt %, the insulation is excessively increased. As a result, thermal conductivity is reduced.

The filler contributes to thermal conductivity and hardness of the thermal pad 140. If the weight percent of the filler is less than 70 wt %, thermal conductivity is reduced so that the thermal pad 140 cannot perform a function of its own, and hardness is reduced so that it is hard to change a shape of the thermal pad 140 into a particular shape. If the weight percent of the filler is greater than 90 wt %, thermal conductivity and hardness are excessively increased, so that errors such as a crack of the thermal pad 140, etc., are generated. Here, the filler is required to be aluminum oxide (alumina).

The glass fiber contributes to hardness of the thermal pad 140. If the weight percent of the glass fiber is less than 2 wt %, hardness is reduced so that the thermal pad 140 is torn and an adhesive strength between the thermal pad 140 and the silicon is reduced. If the weight percent of the glass fiber is greater than 7 wt %, ductility is lost so that errors may be generated.

As the most exemplary embodiment of the thermal pad 140, in terms of weight percent (wt %), silicon of 16 wt %, aluminum oxide of 80 wt %, glass of 3.5 wt % and platinum of 0.5 wt % are required.

Figure 9:
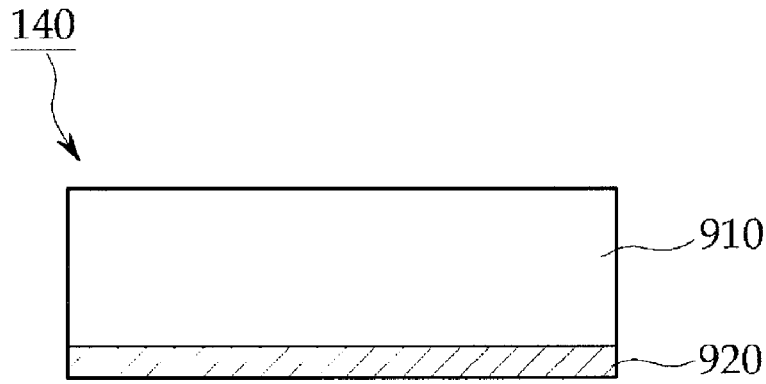
FIG. 9 is a view for describing a structure of a thermal pad.
Figure 9:
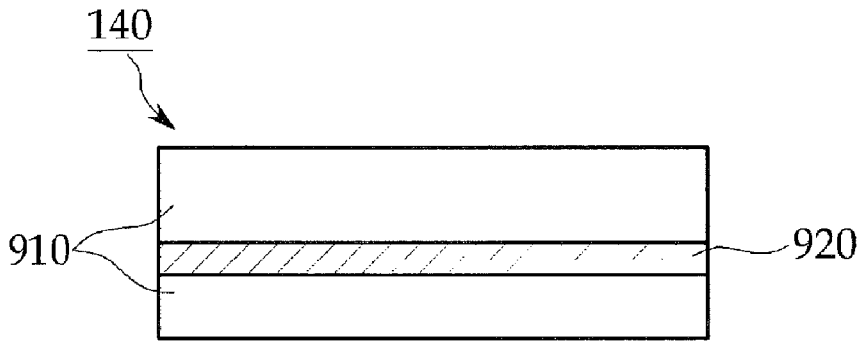

FIG. 9 is a view for describing a structure of a thermal pad 140. An embodiment of the thermal pad 140 is shown in (a) of FIG. 9. Another embodiment of the thermal pad 140 is shown in (b) of FIG. 9.

Referring to FIG. 9, the thermal pad 140 includes a plurality of layers. For example, the thermal pad 140 includes a silicon mixed layer 910 including silicon and a filler, and a fiber layer 920 including glass fiber. As a concrete form of the thermal pad 140, as shown in (a) of FIG. 9, one side of the silicon mixed layer 910 is adhered to one side of the fiber layer 920. Also, as shown in (b) of FIG. 9, the fiber layer 920 is included within the silicon mixed layer 910.

An adhesive agent is applied on one side of the silicon mixed layer 910 of the thermal pad 140, thereby more increasing adhesive strength to the heat radiating body 150 or the light emitting module substrate 130. Specifically, in (a) of FIG. 9, an adhesive agent is applied on an upper side of the silicon mixed layer 910, that is, a side with which the fiber layer 920 does not contact. In (b) of FIG. 9, an adhesive agent is applied on one side or both sides of the silicon mixed layer 910.

In case of the lighting device 1 of 3.5 watts to 8 watts, the thickness of the thermal pad 140 is required to be from 0.4 T to 0.7 T. In case of the lighting device 1 of 15 watts, the thickness of the thermal pad 140 is required to be from 0.7 T to 1.0 T. Here, "T" is a thickness unit. 1T corresponds to 1 mm.

The following table 1 shows a withstand voltage characteristic according to the thickness of the thermal pad 140 in case of the lighting device 1 of 3.5 watts to 8 watts. The following table 2 shows a withstand voltage characteristic according to the thickness of the thermal pad 140 in case of the lighting device 1 of 15 watts. Here, the withstand voltage characteristic shows whether a lighting standard is satisfied or not. When a high voltage and a high current are applied to the heat radiating body 150 and the light emitting module substrate 130, the withstand voltage characteristic shows whether the heat radiating body 150 and the light emitting module substrate 130 penetrate the thermal pad 140 and are short-circuited. An experiment regarding the following tables 1 and 2 is performed by applying a maximum voltage of 5 KV and a maximum current of 100 mA in accordance with Korean withstand voltage acceptance criteria.

The following table 1 shows experimental results when the size of the thermal pad 140 is 45ϕ, the size of the light emitting module substrate 130 is 43ϕ, and the size of the through-hole 153 of the heat radiating body 150 is 15ϕ.

TABLE 1

| Thickness of the thermal pad 140 | PASS or FAIL of a withstand voltage |
|---|---|
| 0.25 T | In case of the lighting device of 5 watts, FAIL at 2.5 KV<br>In case of the lighting device of 8 watts, FAIL at 4.0 KV |
| 0.4 T | PASS |
| 0.7 T | PASS |

The following table 2 shows experimental results when the size of the thermal pad 140 is 70ϕ, the size of the light emitting module substrate 130 is 69ϕ, and the size of the through-hole 153 of the heat radiating body 150 is 15ϕ.

TABLE 2

| Thickness of the thermal pad 140 | PASS or FAIL of a withstand voltage |
|---|---|
| 0.25 T | FAIL |
| 0.4 T | FAIL at 2.0 KV |
| 0.7 T | PASS |

In table 1, in case of the lighting device of 3.5 watts to 8 watts, the thickness of the thermal pad 140 is required to be less than 0.7 T. This is because, when the thickness of the thermal pad 140 is greater than 0.7 T, heat radiating characteristic is deteriorated and production cost is high while the withstand voltage characteristic is improved.

In table 2, in case of the lighting device of 15 watts, the thickness of thermal pad 140 is required to be less than 1.0 T. This is because, when the thickness of the thermal pad 140 is greater than 1.0 T, heat radiating characteristic is deteriorated and production cost is high while the withstand voltage characteristic is improved.

The following table 3 shows a withstand voltage characteristic according to the thickness of the thermal pad 140 in case of the lighting device 1 of 5 watts and 8 watts. The following table 4 shows a withstand voltage characteristic according to the thickness of the thermal pad 140 in case of the lighting device 1 of 15 watts.

The following table 3 shows experimental results when the size of the thermal pad 140 is 52ϕ, and the size of the through-hole 153 of the heat radiating body 150 is 15ϕ.

TABLE 3

| Thickness of the thermal pad 140 | PASS or FAIL of a withstand voltage |
|---|---|
| 0.25 T | In case of the lighting device of 5 watts and 8 watts, FAIL at 3.7 KV |
| 0.5 T | In case of the lighting device of 5 watts, PASS at 4.0 KV<br>In case of the lighting device of 8 watts, FAIL at 3.9 KV |
| 0.7 T | In case of the lighting device of 8 watts, PASS at 4.0 KV |

The following table 4 shows experimental results when the size of the thermal pad 140 is 74ϕ, and the size of the through-hole 153 of the heat radiating body 150 is 15ϕ.

TABLE 4

| Thickness of the thermal pad 140 | PASS or FAIL of a withstand voltage |
|---|---|
| 0.25 T | FAIL at 1.5 KV |
| 0.5 T | FAIL at 2.0 KV |
| 0.7 T | PASS at 4.0 KV |

The first protection ring 120 is formed of a rubber material, a silicon material or other electrical insulating material. The first protection ring 120 is formed in the circumference of the light emitting module substrate 130. More specifically, as shown, the first protection ring 120 includes a step difference 121 in an inner lower end thereof. The lateral surface of the light emitting module substrate 130 and the circumference of the top surface of the light emitting module substrate 130 come in contact with the step difference 121 of the inner lower end of the first protection ring 120. An area contacting with the step difference 121 is not limited to this. Additionally, an inner upper end of the first protection ring 120 may includes an inclination 122 in order to improve the light distribution of the light emitting module substrate 130.

The first protection ring 120 not only prevents moisture and impurities from penetrating between the guide member 100 and the light emitting module substrate 130 but also prevents the lateral surface of the light emitting module substrate 130 from directly contacting with the heat radiating body 150. As a result, it is possible to improve a withstand voltage characteristic of the lighting device 1 and to prevent EMI, EMS and the like of the lighting device 1.

The first protection ring 120 strongly fixes and protects the light emitting module substrate 130, improving the reliability of the lighting device 1.

Figure 12:
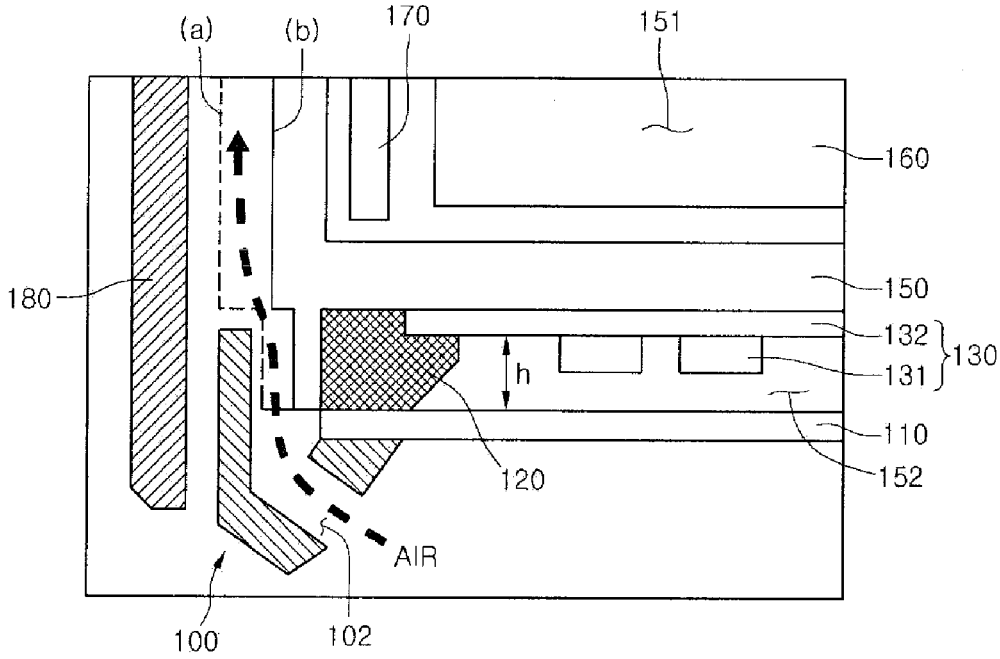
FIG. 12 is a cross sectional view showing an enlarged lower part of the lighting device of FIG. 1.

Referring to FIG. 12, when the lens 110 is disposed on the first protection ring 120, the first protection ring 120 allows the lens 110 to be disposed apart from the light emitting module substrate 130 by a first distance "h". As a result, it is much easier to control the light distribution of the lighting device 1.

Guide Member 100

Figure 10:
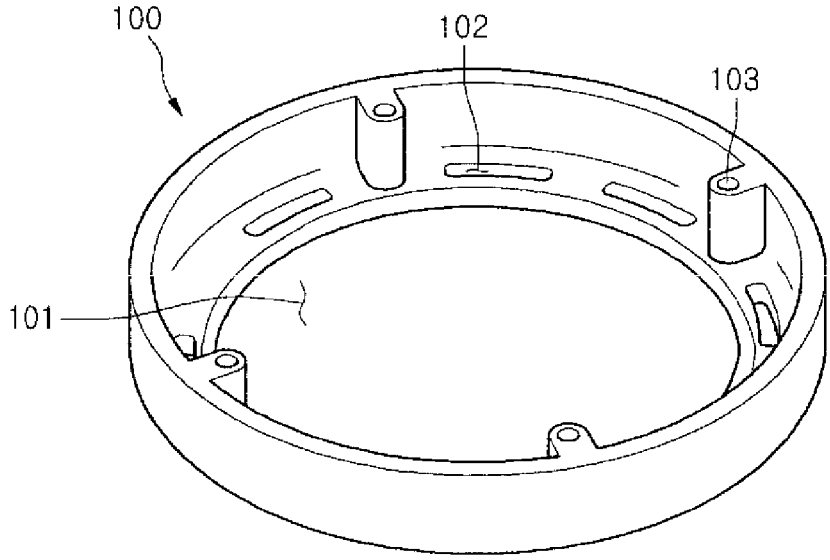
FIG. 10 is a perspective view of a guide member of the lighting device of FIG. 1.
Figure 11:
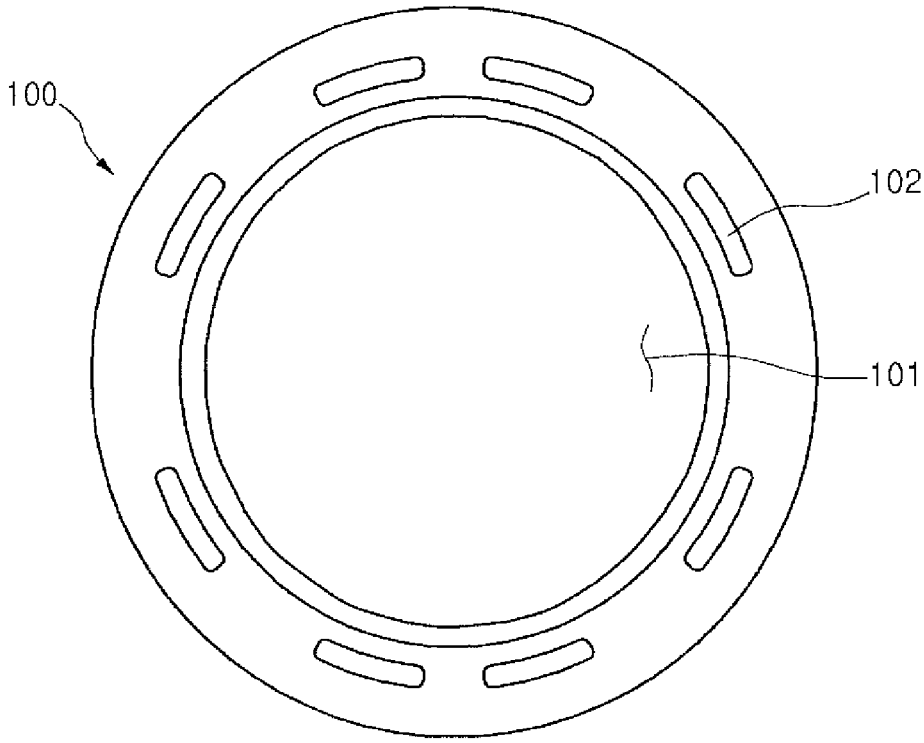
FIG. 11 is a plan view of the guide member of FIG. 10.

FIG. 10 is a perspective view of a guide member 100. FIG. 11 is a plan view of the guide member of FIG. 14.

Referring to FIGS. 4, 10 and 11, the guide member 100 includes an opening 101 for exposing the light emitting module substrate 130, a plurality of heat radiating holes 102 between the inside and the outside of the guide member 100, and a locking groove 103 coupled to the heat radiating body 150.

While the guide member 100 is shown in the form of a circular ring, the guide member 100 can have also shapes such as a polygon and an elliptical ring. There is no limit to the shape of the guide member 100.

The one or a plurality of the light emitting devices 131 of the light emitting module substrate 130 are exposed through the opening 101. Since the guide member 100 presses the light emitting module substrate 130 to the second receiving groove 152, the width of the opening 101 is required to be less than that of the light emitting module substrate 130.

More specifically, as the guide member 100 is coupled to the heat radiating body 150, the guide member 100 give a pressure to the lens 110, the first protection ring 120 and the circumference of the light emitting module substrate 130. Accordingly, the lens 110, the first protection ring 120 and the light emitting module substrate 130 can be securely fixed to the second receiving groove 152 of the heat radiating body 150, thereby improving the reliability of the lighting device 1.

The guide member 100 can be coupled to the heat radiating body 150 through the locking groove 103. For example, as shown in FIG. 4, a hole of the first fastening member 154 of the heat radiating body 150 is in a line with the locking groove 103 of the guide member 100. Then, the guide member 100 is coupled to the heat radiating body 150 by inserting a screw into the hole of the first fastening member 154 and the locking groove 103. However, there is no limit to the method for coupling the guide member 100 to the heat radiating body 150.

Meanwhile, when internal parts such as the driving unit 160 and the light emitting module substrate 130 and the like of the lighting device 1 are required to be changed, the guide member 100 is easily separated from the heat radiating body 150. Therefore, users can perform maintenance for the lighting device 1 without difficulty.

The plurality of the first heat radiating holes 102 are formed between the inside of the outside of the guide member 100. The plurality of the first heat radiating holes 102 allows air inside the lighting device 1 to smoothly flow, thereby maximizing heat radiation efficiency. Hereinafter, a description thereof will be provided.

Figure 13:
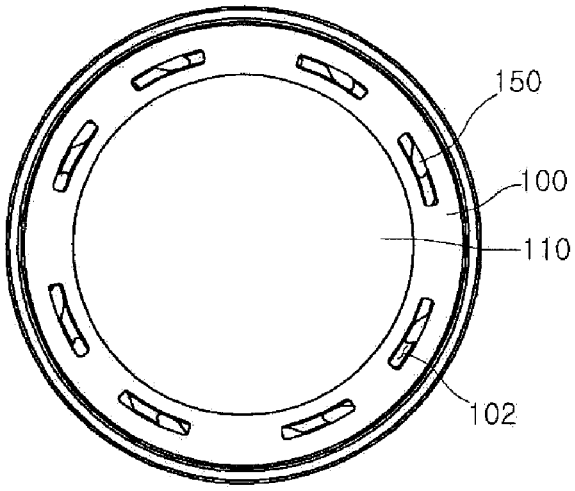
FIG. 13 is a bottom view of the lighting device of FIG. 1.
Figure 14:
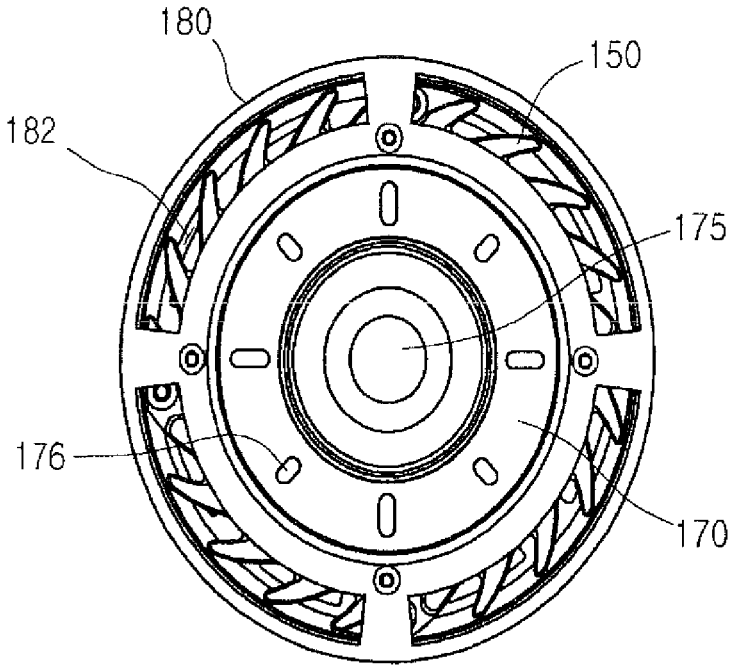
FIG. 14 is a top view of the lighting device of FIG. 1.

FIG. 12 is a cross sectional view showing an enlarged lower part of the lighting device 1 according to the embodiment. FIG. 13 is a bottom view of the lighting device 1. FIG. 14 is a top view of the lighting device 1.

Referring to FIGS. 12 to 14, the outer case 180 is spaced apart at a predetermined interval from the heat radiating body 150 and surrounds the outer surface of the heat radiating body 150. An air flow path is hereby created. Air which has flown into the inside of the lighting device 1 through the plurality of the first heat radiating holes 102 formed in the guide member 100 flows along the air flow path and induces the heat radiating body to radiate heat. Specifically, the air which has flown into the lighting device flows to a prominence "a" and depression "b" of the lateral surface of the heat radiating body 150. Based on a principle of air convection, the air heated by passing through the prominence and depression structure of the heat radiating body 150 can flow out through a plurality of ventilating holes 182 formed between the inner case 170 and the outer case 180. Otherwise, air flown into the plurality of the ventilating holes 182 may flow out through the plurality of the first heat radiating holes 102. Air can flow out in various ways without being limited to this.

In other words, it is possible to radiate heat by using the principle of air convection through the plurality of the first heat radiating holes 102 and the plurality of the ventilating holes 182, thereby maximizing heat radiation efficiency. Hereinafter, a description thereof will be provided.

Figure 15:
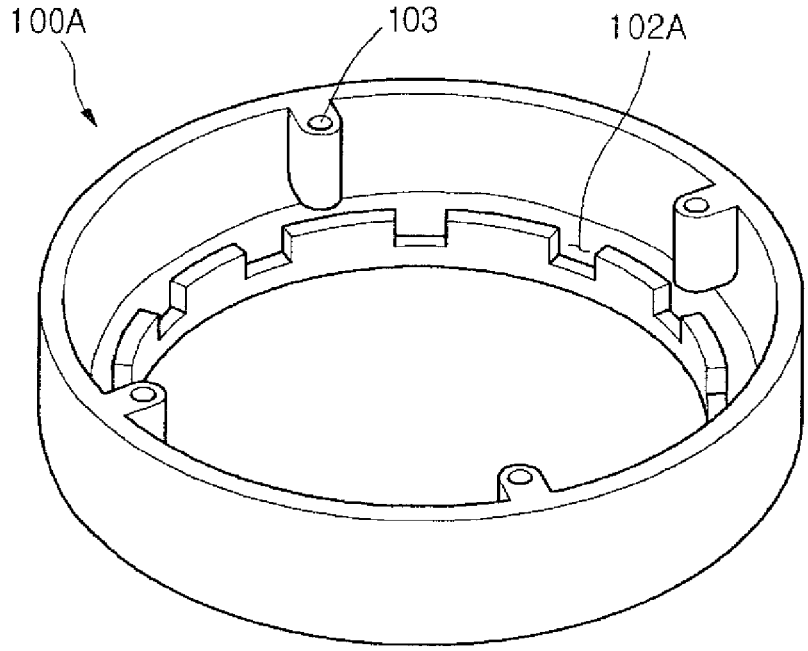
FIG. 15 is a perspective view of a guide member of a lighting device according to another embodiment.

Meanwhile, the air flow structure of the guide member 100 is not limited to this and can be changed variously. For example, as shown in FIG. 15, a guide member 100A according to another embodiment has a prominence and depression structure in the inner surface thereof, so that air can flow into the inside of the lighting device through a depression 102A.

Lens 110

Referring to FIGS. 4 and 12, the lens 110 is formed under the light emitting module substrate 130 and controls the distribution of light emitted from the light emitting module substrate 130.

The lens 110 has various shapes. For example, the lens 110 includes at least one of a parabola-shaped lens, a fresnel lens, a convex lens or a concave lens.

The lens 110 is disposed under the light emitting module substrate 130 and spaced apart from the light emitting module substrate 130 by a first distance "h". The first distance "h" is greater than 0 mm and equal to or less than 50 mm in accordance with the design of the lighting device 1.

The distance "h" is maintained by the first protection ring 120 disposed between the light emitting module substrate 130 and the lens 110. Otherwise, if another support for supporting the lens 110 is provided in the second receiving groove 152 of the heat radiating body 150, the distance "h" is maintained between the light emitting module substrate 130 and the lens 110. There is no limit to the method for maintaining the distance "h".

The lens 110 is fixed by the guide member 110. The inner surface of the guide member 100 contacts with the lens 110. The lens 110 and the light emitting module substrate 130 are pressed and fixed to the second receiving groove 152 of the heat radiating body 150 by the inner surface of the guide member 100.

The lens 110 is made of glass, polymethylmethacrylate (PMMA) and polycarbonate (PC) and so on.

According to the design of the lighting device 1, the lens 110 includes fluorescent material. Otherwise, a photo luminescent film (PLF) including the fluorescent material is attached to a light incident surface or a light emitting surface of the lens 110. Light emitted from the light emitting module substrate 130 by the fluorescent material is emitted with a varied wavelength.

Inner Case 170

Figure 16:
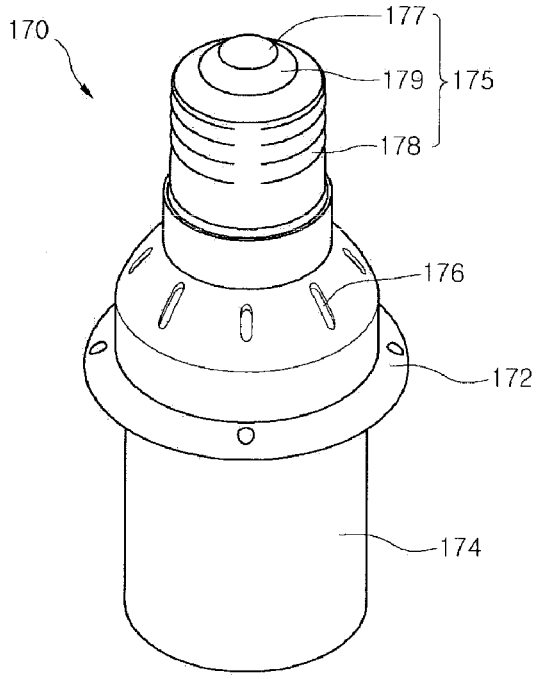
FIG. 16 is a perspective view of an inner case of the lighting device of FIG. 1.

FIG. 16 is a perspective view of the inner case 170.

Referring to FIGS. 4 and 16, the inner case 170 includes an insertion unit 174 inserted into the first receiving groove 151 of the heat radiating body 150, a connection terminal 175 electrically connected to an external power supply, and a second fastening member 172 coupled to the outer case 180.

The inner case 170 is made of a material with excellent insulating properties and endurance, for example, a resin material.

The insertion unit 174 is formed in the lower part of the inner case 170. A side wall of the insertion unit 174 is inserted into the first receiving groove 151 so that an electrical short-circuit between the driving unit 160 and the heat radiating body 150 is prevented. As a result, a withstand voltage of the lighting device 1 can be improved.

The connection terminal 175 is, for example, connected to an external power supply in the form of a socket. That is, the connection terminal 175 includes a first electrode 177 at the top thereof, a second electrode 178 on the lateral surface thereof, and an insulating member 179 between the first electrode 177 and the second electrode 178. The first and second electrodes 177 and 178 are supplied with electric power by an external power supply. Here, since the shape of the terminal 175 is variously changed based on the design of the lighting device 1, there is no limit to the shape of the terminal 175.

The second fastening member 172 is formed on the lateral surface of the inner case 170 and includes a plurality of holes. The inner case 170 is coupled to the outer case 180 by inserting screws and the like into the plurality of the holes.

Moreover, a plurality of second heat radiating holes 176 are formed in the inner case 170, improving the heat radiation efficiency of the inside of the inner case 170.

Driving Unit 160 and Internal Structure of Inner Case 170

Referring to FIG. 4, the driving unit 160 is disposed in the first receiving groove 151 of the heat radiating body 150.

The driving unit 160 includes a supporting substrate 161 and a plurality of parts 162 mounted on the supporting substrate 161. A plurality of the parts 162 include, for example, a converter converting an alternating current supplied from an external power supply into a direct current, a driving chip controlling to drive the light emitting module substrate 130, an electrostatic discharge (ESD) protective device protecting the light emitting module substrate 130. The driving unit 160 is not limited to include other components.

Here, as shown, the supporting substrate 161 is disposed vertically in order that air flows smoothly in the inner case 170. Therefore, as compared with a case where the supporting substrate 161 is disposed horizontally, air flows up and down in the inner case 170 due to air convection, thereby improving the heat radiation efficiency of the lighting device 1.

In the meantime, the supporting substrate 161 may be disposed horizontally in the inner case 170. The supporting substrate 161 can be disposed in various ways without being limited to this.

The driving unit 160 is electrically connected to the connection terminal 175 of the inner case 170 by a first wiring 164 and to the light emitting module substrate 130 by a second wiring 165.

Specifically, the first wiring 164 is connected to the first electrode 177 and the second electrode 178 of the connection terminal 175 so that electric power is supplied from an external power supply.

The second wiring 165 passes through the through-hole 153 of the heat radiating body 150 and electrically connects the driving unit 160 with the light emitting module substrate 130.

The supporting substrate 161 is disposed vertically in the inner case 170. Therefore, a long-term use of the lighting device 1 causes the supporting substrate 161 to press and damage the second wiring 165.

Figure 17:
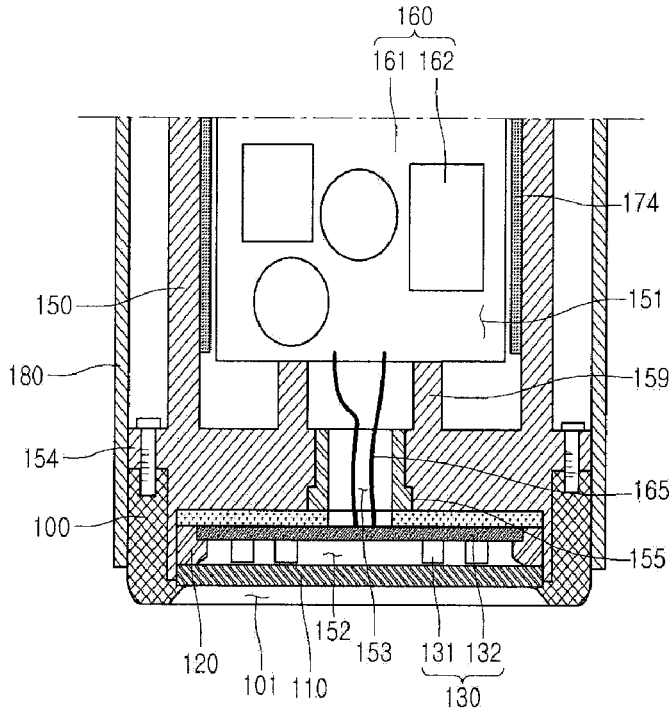
FIG. 17 is a view showing a heat radiating body of the lighting device according to the another embodiment.

Accordingly, in the embodiment, as shown in FIG. 17, a projection 159 is formed on the basal surface of the light emitting module substrate 130 in the vicinity of the through-hole 153, so that it is possible not only to support the supporting substrate 161 but to prevent in advance the second wiring 165 from being damaged.

Outer Case 180

The outer case 180 is coupled to the inner case 170, receives the heat radiating body 150, the light emitting module substrate 130 and the driving unit 160, etc., and forms an external shape of the lighting device 1.

Since the outer case 180 surrounds the heat radiating body 150, a burn accident and an electric shock can be prevented and a user can manage the lighting device 1 with ease. Hereinafter, the outer case 180 will be described in detail.

Figure 18:
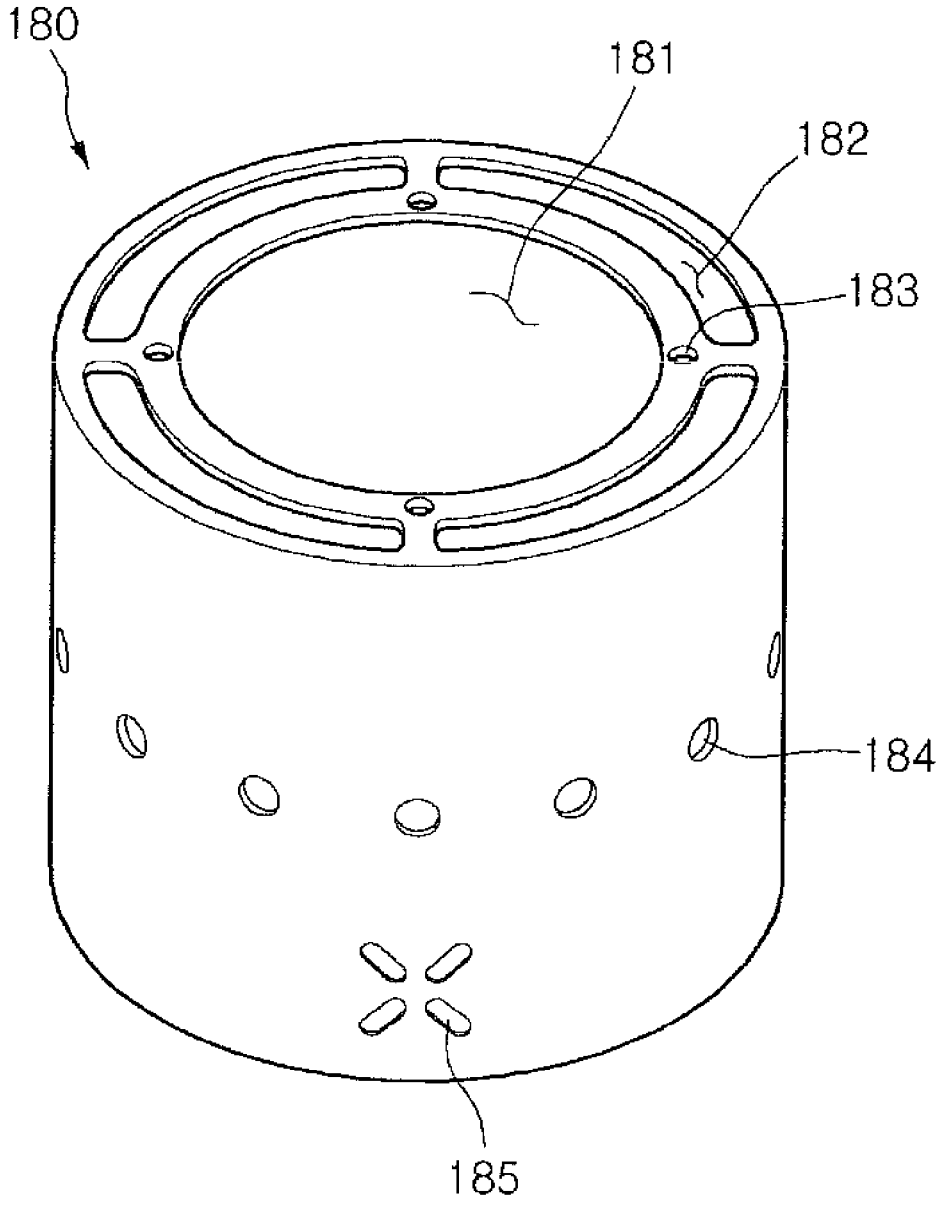
FIG. 18 is a perspective view of an outer case of the lighting device of FIG. 1.

FIG. 18 is a perspective view of an outer case 180.

Referring to FIG. 18, the outer case 180 includes an opening 181 into which the inner case 170 and the like are inserted, a coupling groove 183 coupled to the second fastening member 172 of the inner case 170, and a plurality of ventilating holes 182 for allowing air to flow into the lighting device or to flow to the outside of the lighting device.

The outer case 180 is made of a material with excellent insulation and endurance, for example, a resin material.

The inner case 170 is inserted into the opening 181 of the outer case 180. The second fastening member 172 of the inner case 170 is coupled to the coupling groove 183 by means of a screw and the like. As a result, the outer case 180 and the inner case 170 are coupled to each other.

As described above, the plurality of the ventilating holes 182 as well as the plurality of the first heat radiating holes 102 of the guide member 100 allow air to smoothly flow in the lighting device 1, thereby improving the heat radiation efficiency of the lighting device 1.

As shown, the plurality of the ventilating holes 182 are formed in the circumference of the top surface of the outer case 180. The ventilating hole 182 has an arc-shape like a fan. However, there is no limit to the shape of the ventilation hole 182. Additionally, the coupling groove 183 is formed between the plurality of the ventilating holes 182.

Meanwhile, the lateral surface of the outer case 180 may include at least a marking groove 185 and a plurality of holes 184. The hole 184 is used to enhance heat radiation efficiency. The marking groove 185 is used to easily managing the lighting device 1. However, it is not necessary to form the plurality of holes 184 and the marking groove 185. There is no limit to the formation of the hole 184 and the marking hole 185.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

The features, structures and effects and the like described in the embodiments are included in at least one embodiment of the present invention and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present invention.

What is claimed is:

1. A lighting device comprising:

a substrate;

a light emitting device disposed on the substrate;

a heat sink to radiate heat from the light emitting device; and a pad being interposed between the substrate and the heat sink and transferring heat generated from the light emitting device to the heat sink and comprising silicon of 10 to 30 wt ° A, a filler of 70 to 90 wt %, glass fiber of 2 to 7 wt % in terms of weight percent (wt %), wherein the light emitting device includes an LED.

2. The lighting device of claim 1, wherein the pad further comprises platinum compound as a catalyst.

3. The lighting device of claim 1, wherein the filler comprises aluminum oxide.

4. The lighting device of claim 1, wherein the pad comprises:

a silicon mixed layer comprising the silicon and the filler; and a fiber layer comprising the glass fiber.

5. The lighting device of claim 4, wherein the fiber layer is comprised within the silicon mixed layer.

6. The lighting device of claim 5, wherein an adhesive agent is disposed on one side of the silicon mixed layer.

7. The lighting device of claim 1, wherein the thickness of the pad is from 0.4 T to 0.7 T in case of the lighting device having a power consumption of 3.5 watts to 8 watts.

8. The lighting device of claim 1, wherein the thickness of the pad is from 0.7 T to 1.0 T in case of the lighting device having a power consumption of 15 watts.

9. The lighting device of claim 1, wherein the area of thermal pad is larger than that of the substrate.

10. The lighting device of claim 1, wherein one side of the heat sink receives the substrate and the pad.

11. The lighting device of claim 1, further comprising an outer case being spaced apart from an outer surface of the heat sink and surrounding the heat sink.

12. The lighting device of claim 11, wherein an outer surface of the heat sink comprises at least one heat radiating fin extending from the outer surface.

13. The lighting device of claim 1, further comprising a guide member surrounding a lower end of the heat sink such that the substrate is fixed to the heat sink, wherein the surface of the guide member comprises a hole for allowing external air to flow into the lighting device.

14. The lighting device of claim 1, wherein the light emitting device comprises a plurality of light emitting devices disposed in substantially a radial arrangement based on a central axis of the substrate, and wherein the pad is interposed between the substrate and the heat sink in correspondence with an area of the substrate, on which the plurality of the light emitting devices is disposed.

15. The lighting device of claim 14, wherein a part of the pad is open.

16. A lighting device comprising:

a substrate;

a light emitting device disposed on the substrate;

a heat sink to radiate radiating heat from the light emitting device; and a pad being interposed between the substrate and the heat sink and comprising a plurality of layers and comprising silicon of 10 to 30 wt % and a filler of 70 to 90 wt % in terms of weight percent (wt %), wherein the light emitting device includes an LED.

17. The lighting device of claim 16, wherein the pad comprises a mixed layer comprising silicon and comprises a fiber layer comprising glass fiber.

18. The lighting device of claim 17, wherein the mixed layer further comprises a filler comprising aluminum oxide.

19. A lighting device comprising:

a light emitting module substrate comprising a plurality of light emitting devices;

a pad being disposed on one side of the light emitting module substrate and comprising a plurality of layers and comprising a glass fiber and a filler of 70 to 90 weight (wt) % in terms of weight percent (wt %);

a heat sink comprising a receiving groove for receiving the pad and the light emitting module substrate so that one side of the heat sink contacts with the pad;

an outer case being spaced apart at a predetermined interval from the outer surface of the heat sink and surrounding the heat sink, wherein each of the light emitting devices includes an LED.

20. The lighting device of claim 19, wherein the pad transfers heat generated from a plurality of the light emitting device to the heat sink.

* * * * *